US009578426B2

(12) United States Patent
Gigandet

(10) Patent No.: US 9,578,426 B2
(45) Date of Patent: Feb. 21, 2017

(54) METHOD FOR FEEDBACK CANCELLING IN HEARING DEVICES AND HEARING DEVICE WITH A FEEDBACK CANCELLER

(71) Applicant: Phonak AG, Stafa (CH)

(72) Inventor: Xavier Gigandet, Middes (CH)

(73) Assignee: SONOVA AG, Staefa (CH)

( * ) Notice: Subject to any disclaimer, the term of this patent is extended or adjusted under 35 U.S.C. 154(b) by 0 days.

(21) Appl. No.: 14/663,781

(22) Filed: Mar. 20, 2015

(65) Prior Publication Data

US 2016/0277853 A1 Sep. 22, 2016

(51) Int. Cl.
*H04R 25/00* (2006.01)

(52) U.S. Cl.
CPC ..... *H04R 25/453* (2013.01); *H04R 2460/01* (2013.01)

(58) Field of Classification Search
CPC ..... H04R 25/30
USPC ..... 381/318, 60
See application file for complete search history.

(56) References Cited

U.S. PATENT DOCUMENTS

2009/0316922 A1* 12/2009 Merks ..... H04R 25/30 381/60
2013/0188796 A1* 7/2013 Kristensen ..... H04R 25/453 381/60

* cited by examiner

*Primary Examiner* — Duc Nguyen
*Assistant Examiner* — Phan Le
(74) *Attorney, Agent, or Firm* — Pearne & Gordon LLP

(57) ABSTRACT

An analysis filter bank decomposes a microphone signal into sub-band signals, a gain unit applies a frequency-dependent gain to the sub-band signals, and a synthesis filter bank converts the amplified sub-band signals into a signal, which is then output by a receiver. A first adaptive filter of a feedback canceller provides feedback compensation signals adapted to compensate acoustic feedback from the receiver to the microphone, whereby the feedback compensation signals are subtracted from corresponding signals from the sub-band signals. A second adaptive filter of the feedback canceller estimates cross-frequency signal components resulting from aliasing of signal components from one sub-band into one or more neighboring sub-bands caused by non-ideal sub-band signal decomposition in the analysis filter bank with overlapping sub-bands. Thereby, the first adaptive filter is adapted in dependence of the estimated cross-frequency signal components.

10 Claims, 1 Drawing Sheet

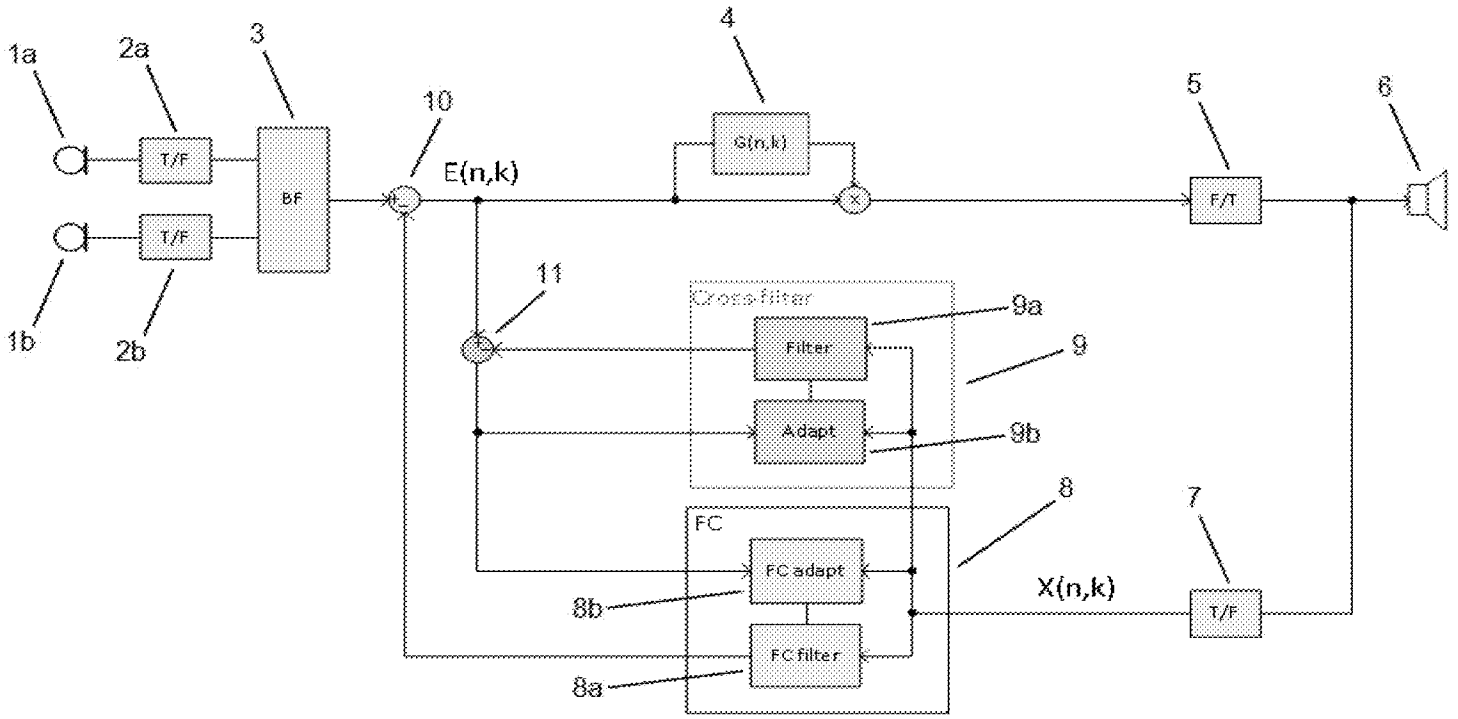
1a
1b
2a
2b
T/F
T/F
3
BF
10
E(n,k)
11
4
G(n,k)
5
F/T
6
7
T/F
X(n,k)
8
8a
8b
FC
FC filter
FC adapt
9
9a
9b
Cross-filter
Filter
Adapt

METHOD FOR FEEDBACK CANCELLING IN HEARING DEVICES AND HEARING DEVICE WITH A FEEDBACK CANCELLER

TECHNICAL FIELD

The present invention relates to hearing devices, in particular the present invention pertains to an improved method for feedback cancelling in hearing devices as well as to a hearing device with an improved feedback canceller.

BACKGROUND OF THE INVENTION

Within the context of the present invention a hearing device is a miniature electronic device capable of stimulating a user's hearing and adapted to be worn at an ear or at least partly within an ear canal of a user. A primary application of hearing devices is to improve the hearing for hearing impaired users. In these cases the hearing devices are more specifically referred to as hearing instruments, hearing aids or hearing prostheses. Other uses of hearing devices pertain to augmenting the hearing of normal hearing persons, for instance by means of noise suppression, to the provision of audio signals originating from remote sources, e.g. within the context of audio communication, and to hearing protection.

In hearing devices feedback arises when a part of the signal output by the receiver (loudspeaker) is picked up by the hearing device microphone(s), gets amplified in the hearing device and starts to loop around, i.e. is repeatedly picked up by the microphone(s), amplified and output by the receiver. When feedback occurs, it results in a disturbingly loud tonal signal. Feedback is more likely to occur when the hearing device volume is increased, when the hearing device is not properly positioned (i.e. fitted) within the ear canal, or when the hearing device is brought close to a reflecting surface (e.g. when using a mobile phone). Adaptive feedback cancellation algorithms are techniques that estimate the transmission path between receiver and microphone(s). This estimate is then used to implement a neutralising electronic feedback path that suppresses the tonal feedback signal. It is usually desired that the feedback canceller operates on a limited frequency range. Indeed, feedback cancellation techniques are known to substantially decrease the sound quality by introducing artifacts, such as entrainment or modulation artifacts. It is therefore advantageous to activate the feedback canceller only in the frequency range where acoustic feedback can occur. Typically, the feedback threshold in the low frequencies is usually much higher than the applied gain. Consequently, feedback cancellation is useless below a given cut-off frequency. The frequency range reduction has a positive impact on the computational load which is proportional to the bandwidth of the feedback canceller.

Signal processing in hearing devices is commonly performed in the frequency domain, i.e. the input signal(s) is/are split into sub-bands by an analysis filter bank. Due to the characteristics of the analysis filter bank, designed according to a compromise between time and frequency resolution, side lobe rejection, delay and other properties, the sub-band decomposition is not perfect and the neighbouring sub-band filters overlap substantially. Consequently, aliasing components are introduced and the sub-bands can no longer be considered individually.

The filter bank aliasing has an important consequence for feedback cancellers based on adaptive filters. Typically, the update equations of the adaptive filter are based on the hypothesis that the filter coefficients can be adapted independently, i.e. that the aliasing components are negligible. If this hypothesis does not hold, the aliasing components induce cross-terms that introduce a bias in the filter estimate. Problems arise in the frequency range where the feedback canceller is not active, because in the case of tonal signals the adaptive algorithm may find a substantial correlation between neighbouring bins, and therefore wrongly estimate the feedback path. This problem is especially prominent when the loop gain is low (quiet environment, combination of expansion gain with other gain reduction, high feedback threshold) and low-frequency tonal signals (<1 kHz) produced by e.g. a computer's fan, air conditioning devices or distant speech picked up by the hearing device microphone(s). Under such conditions the filter coefficients of the first active frequency bins are largely overestimated. As long as the gain is in expansion, no effect is noticed. As soon as an onset of acoustic feedback occurs, the gain and therefore the loop gain increase, and the bias accumulated in the filter coefficients is too high to ensure the stability of the feedback canceller. Short whistles are thus heard until the biased filter coefficients converge back to the target value or until the gain is back to the expansion mode.

In order to ensure an optimal behaviour of the feedback canceller especially in the low frequencies, it is therefore strongly desired to make the feedback cancellation algorithm insensitive to tonal inputs whose spectral content lies outside the operating frequency range of the feedback canceller.

SUMMARY OF THE INVENTION

It is an object of the present invention to propose an improved method for feedback cancelling in hearing devices employing a filter bank where sub-band decomposition is not perfect and neighbouring sub-band filters overlap substantially. It is especially a goal of the present invention to propose a method for feedback cancelling having a decreased sensitivity to tonal inputs and thus avoiding artifacts. These objects are achieved by the method according to claim 1.

It is a further object of the present invention to provide a hearing device capable of performing the proposed method for feedback cancelling. This further object is achieved by the hearing device according to claim 10.

Various specific embodiments of the method and hearing device according to the present invention are given in the dependent claims.

The present invention provides a method for feedback cancelling in a hearing device comprising at least one microphone, an analysis filter bank, a gain unit, a synthesis filter bank, a receiver and a feedback canceller, the method comprising:

- the at least one microphone providing at least one microphone signal;
- the analysis filter bank decomposing the at least one microphone signal into a first plurality of sub-band signals;
- the gain unit applying a frequency-dependent gain to the first plurality of sub-band signals and providing a first plurality of amplified sub-band signals;
- the synthesis filter bank converting the first plurality of amplified sub-band signals into a receiver input signal; and
- the receiver outputting a sound signal dependent on the receiver input signal, characterised in a first adaptive filter of the feedback canceller providing a second plurality of feedback compensation signals adapted to compensate acoustic feedback from the receiver to the at least one microphone, which second plurality of feedback compensation signals are subtracted from corresponding signals from the first plurality of sub-band signals;

a second adaptive filter of the feedback canceller estimating a third plurality of cross-frequency signal components resulting from aliasing of signal components from one sub-band into one or more neighbouring sub-bands caused by non-ideal sub-band signal decomposition in the analysis filter bank with overlapping sub-bands; and adapting the first adaptive filter in dependence of the third plurality of estimated cross-frequency signal components.

In an embodiment the method further comprises subtracting the second plurality of feedback compensation signals from corresponding signals from the first plurality of sub-band signals to provide a first plurality of feedback compensated sub-band signals, and adapting the first adaptive filter in dependence of a difference between the first plurality of feedback compensated sub-band signals and corresponding components from the third plurality of estimated cross-frequency signal components.

In a further embodiment the method further comprises adapting the second adaptive filter in dependence of the difference between the first plurality of feedback compensated sub-band signals and corresponding components from the third plurality of estimated cross-frequency signal components.

In a further embodiment the method further comprises adapting the first and second adaptive filters in dependence of the first plurality of amplified sub-band signals, or decomposing (by a further analysis filter bank) the receiver input signal into a fourth plurality of sub-band feedback signals and adapting the first and second adaptive filters in dependence of the fourth plurality of sub-band feedback signals.

In a further embodiment of the method the analysis filter bank comprises a Hanning window.

In a further embodiment of the method the first plurality is larger than the second plurality and/or the second plurality is larger than or equal to the third plurality.

In a further embodiment the method further comprises adapting the first and second adaptive filters based on a least-mean-squares algorithm, a Levinson-Durbin algorithm, a linear prediction or an autocorrelation determination.

In a further embodiment of the method the first adaptive filter is an adaptive two partitions frequency domain filter, whose coefficients are updated according to the following normalised least-mean-squares (NLMS) equations:

$$h_0(n,k) = h_0(n-1,k) + \mu(n,k)\frac{\overline{X(n,k)}E(n,k)}{|X(n,k)|^2}$$

$$h_1(n,k) = h_1(n-1,k) + \mu(n,k)\frac{\overline{X(n-1,k)}E(n,k)}{|X(n,k)|^2}$$

wherein X(n,k) is an n-th sample of the k-th amplified sub-band signal, E(n,k) is the n-th sample at the k-th frequency of an error signal resulting from a subtraction of the second plurality of feedback compensation signals from corresponding signals from the first plurality of sub-band signals, $h_0$ and $h_1$ are filter coefficients of the first and second partitions of the first adaptive filter, respectively, μ(n,k) is a frequency-dependent adaptation speed of the first adaptive filter, and $|X(n,k)|^2$ is a normalisation term of the first adaptive filter, and wherein the second adaptive filter is also an adaptive two partitions frequency domain filter, whose coefficients are updated according to the following NLMS equations:

$$h_{c0}(n,k) = h_{c0}(n-1,k) + \mu_c(n,k)\frac{\overline{X(n,k-1)}E(n,k)}{|X(n,k-1)|^2}$$

$$h_{c1}(n,k) = h_{c1}(n-1,k) + \mu_c(n,k)\frac{\overline{X(n-1,k-1)}E(n,k)}{|X(n,k-1)|^2}$$

wherein $h_{c0}$ and $h_{c1}$ are filter coefficients of the first and second partitions of the second adaptive filter, respectively, and $\mu_c(n,k)$ is a frequency-dependent adaptation speed of the second adaptive filter.

In a further embodiment of the method in the equations for updating the coefficients of the second adaptive filter the terms X(n,k−1) are replaced by the sum X(n,k−1)+X(n,k−2), in particular by the sum of M samples X(n,k−1)+ . . . + X(n,k−M).

In a further embodiment of the method the adaptation speed μ(n,k) of the first adaptive filter and the adaptation speed $\mu_c(n,k)$ of the second adaptive filter are different.

In a further embodiment of the method the second plurality of feedback compensation signals from the first adaptive filter are within the frequency range from 800 Hz to 11 kHz.

In a further embodiment of the method the third plurality of cross-frequency signal components from the second adaptive filter are within the frequency range from 800 Hz to 3 kHz, in particular within the frequency range from 1 to 1.7 kHz.

In a further embodiment of the method the frequency-dependent gain is time-varying.

The present invention further provides a hearing device, comprising:

at least one microphone providing at least one microphone signal;

an analysis filter bank adapted to decompose the at least one microphone signal into a first plurality of sub-band signals;

a gain unit adapted to apply a frequency-dependent gain to the first plurality of sub-band signals and to provide a first plurality of amplified sub-band signals;

a synthesis filter bank adapted to convert the first plurality of amplified sub-band signals into a receiver input signal;

a receiver adapted to output a sound signal dependent on the receiver input signal; and a feedback canceller unit, wherein the feedback canceller unit comprises a first adaptive filter and a second adaptive filter, wherein the first adaptive filter is configured to provide a second plurality of feedback compensation signals adapted to compensate acoustic feedback from the receiver to the at least one microphone, which second plurality of feedback compensation signals are provided for subtraction from corresponding signals from the first plurality of sub-band signals, and the second adaptive filter is adapted to estimate a third plurality of cross-frequency signal components resulting from aliasing of signal components from one sub-band into one or more neighbouring sub-bands caused by non-ideal sub-band signal decomposition in the analysis filter bank with overlapping sub-bands, and wherein adaption of the first adaptive filter is dependent on the third plurality of estimated cross-frequency signal components.

In an embodiment the hearing device is configured to subtract the second plurality of feedback compensation signals from corresponding signals from the first plurality of sub-band signals to provide a first plurality of feedback compensated sub-band signals, and wherein the first adaptive filter is configured to be adapted dependent on a difference between the first plurality of feedback compensated sub-band signals and corresponding components from the third plurality of estimated cross-frequency signal components.

In a further embodiment of the hearing device the second adaptive filter is configured to be adapted dependent on the difference between the first plurality of feedback compensated sub-band signals and corresponding components from the third plurality of estimated cross-frequency signal components.

In a further embodiment of the hearing device the first and second adaptive filters are configured to be adapted dependent on the first plurality of amplified sub-band signals, or wherein the hearing device comprises a further analysis filter bank adapted to decompose the receiver input signal into a fourth plurality of sub-band feedback signals, and wherein the first and second adaptive filters are configured to be adapted dependent on the fourth plurality of sub-band feedback signals.

In a further embodiment of the hearing device the analysis filter bank comprises a Hanning window.

In a further embodiment of the hearing device the first plurality is larger than the second plurality and/or the second plurality is larger than or equal to the third plurality.

In a further embodiment of the hearing device the first and second adaptive filters are configured to be adapted based on a least-mean-squares algorithm, a Levinson-Durbin algorithm, a linear prediction or an autocorrelation determination.

In a further embodiment of the hearing device the first adaptive filter is an adaptive two partitions frequency domain filter, whose coefficients are given by the following normalised least-mean-squares (NLMS) equations:

$$h_0(n,k) = h_0(n-1,k) + \mu(n,k)\frac{\overline{X(n,k)}E(n,k)}{|X(n,k)|^2}$$

$$h_1(n,k) = h_1(n-1,k) + \mu(n,k)\frac{\overline{X(n-1,k)}E(n,k)}{|X(n,k)|^2}$$

wherein X(n,k) is an n-th sample of the k-th amplified sub-band signal, E(n,k) is the n-th sample at the k-th frequency of an error signal resulting from a subtraction of the second plurality of feedback compensation signals from corresponding signals from the first plurality of sub-band signals, $h_0$ and $h_1$ are filter coefficients of the first and second partitions of the first adaptive filter, respectively, μ(n,k) is a frequency-dependent adaptation speed of the first adaptive filter, and $|X(n,k)|^2$ is a normalisation term of the first adaptive filter, and wherein the second adaptive filter is also an adaptive two partitions frequency domain filter, whose coefficients are updated according to the following NLMS equations:

$$h_{c0}(n,k) = h_{c0}(n-1,k) + \mu_c(n,k)\frac{\overline{X(n,k-1)}E(n,k)}{|X(n,k-1)|^2}$$

$$h_{c1}(n,k) = h_{c1}(n-1,k) + \mu_c(n,k)\frac{\overline{X(n-1,k-1)}E(n,k)}{|X(n,k-1)|^2}$$

wherein $h_{c0}$ and $h_{c1}$ are filter coefficients of the first and second partitions of the second adaptive filter, respectively, and $\mu_c(n,k)$ is a frequency-dependent adaptation speed of the second adaptive filter.

In a further embodiment of the hearing device in the equations for updating the coefficients of the second adaptive filter the terms X(n,k−1) are replaced by the sum X(n,k−1)+X(n,k−2), in particular by the sum of M samples X(n,k−1)+ . . . +X(n,k−M).

In a further embodiment of the hearing device the adaptation speed μ(n,k) of the first adaptive filter and the adaptation speed $\mu_c(n,k)$ of the second adaptive filter are different.

In a further embodiment of the hearing device the second plurality of feedback compensation signals from the first adaptive filter are within the frequency range from 800 Hz to 11 kHz.

In a further embodiment of the hearing device the third plurality of cross-frequency signal components from the second adaptive filter are within the frequency range from 800 Hz to 3 kHz, in particular within the frequency range from 1 kHz to 1.7 kHz.

In a further embodiment the hearing device further comprises a decorrelation unit, particularly a frequency shift unit, in particular being active in the frequency range from 1.7 to 11 kHz.

In a further embodiment the hearing device further comprises a beamforming unit adapted to pre-process the at least one microphone signal or to process the first plurality of sub-band signals.

In a further embodiment of the hearing device the frequency-dependent gain is time-varying.

In a further embodiment the hearing device is a hearing aid.

It is pointed out that combinations of the above-mentioned embodiments can yield even further, more specific embodiments according to the present invention.

BRIEF DESCRIPTION OF THE DRAWINGS

The present invention is further explained below by means of non-limiting specific embodiments and with reference to the accompanying drawing, which show:

FIG. 1 a block diagram of an exemplary embodiment of a hearing device according to the present invention.

DETAILED DESCRIPTION OF THE INVENTION

FIG. 1 depicts a block diagram of an embodiment of a hearing device according to the present invention. The hearing device comprises two microphones 1*a*, 1*b*, two analysis filter banks 2*a*, 2*b* for performing time-to-frequency domain conversion, a beamformer 3, a frequency-dependent and time-varying gain 4, a synthesis filter bank 5 for performing frequency-to-time domain conversion and a receiver 6. Additionally, a first frequency domain adaptive filtering unit 8 estimates the acoustic feedback path and subtracts this estimate from the forward path signal using the subtractor 10. The first adaptive filter 8 (consisting of a filtering part 8*a* and a coefficient adapting part 8*b*) is implemented as an adaptive two-partitions frequency domain filter, whose coefficients are given by the normalised least-mean (NLMS) equations:

$$h_0(n,k) = h_0(n-1,k) + \mu(n,k)\frac{\overline{X(n,k)}E(n,k)}{|X(n,k)|^2}$$

$$h_1(n,k) = h_1(n-1,k) + \mu(n,k)\frac{\overline{X(n-1,k)}E(n,k)}{|X(n,k)|^2}$$

with $h_0$, $h_1$ being filter coefficients of the first and second partitions, respectively, $\mu(n,k)$ being a frequency-dependent adaptation speed, and $|X(n,k)|^2$ being a normalisation term.

Due to the characteristics of the analysis filter banks 2*a*, 2*b*, which are designed based on a compromise between time and frequency resolution, side lobe rejection, delay and other properties, the sub-band decomposition is not perfect and the neighbouring sub-band filters overlap substantially. Consequently, aliasing components are introduced and the sub-bands can no longer be considered individually. The analysis filter bank aliasing has an important consequence for the first adaptive filter. Indeed, the update equations given above are based on the assumption that the filter coefficients can be adapted independently, i.e. that the aliasing components are negligible. If this assumption does not hold, the aliasing components induce cross-terms that introduce a bias in the filter estimate.

The filter 8*a* therefore contains both the expected estimate of the acoustic feedback path and the cross-terms due to aliasing. The proposed solution consists of adding a second adaptive filter 9 ("cross-filter") in parallel with the first adaptive filter 8, whose aim is to estimate the cross-terms only. The second adaptive filter 9 (again consisting of a filtering part 9*a* and a coefficient adapting part 9*b*) is primarily estimating the cross-terms, whilst the first adaptive filter 8 converges to the acoustic feedback path only. Consequently, the parallel, second adaptive filter 9 allows to decouple the effective acoustic feedback path from the cross-terms. Advantageously, the parallel, second adaptive filter 9 only affects the error signal (i.e. the output of the subtractor 11) applied to the first adaptive filter 8, such that it has no impact on the output of the hearing device provided by the receiver 6.

The second adaptive filter 9 is essentially identical to the first adaptive filter 8, except that the update equations are modified as follows:

$$h_{c0}(n,k) = h_{c0}(n-1,k) + \mu(n,k)\frac{\overline{X(n,k-1)}E(n,k)}{|X(n,k-1)|^2}$$

$$h_{c1}(n,k) = h_{c1}(n-1,k) + \mu(n,k)\frac{\overline{X(n-1,k-1)}E(n,k)}{|X(n,k-1)|^2}$$

The input signal X(n,k) is replaced by X(n,k−1), such that the correlation is computed across the adjacent bins. In this way, the filter estimates the cross-terms arising from the overlap of the adjacent bins. Similarly, the concept can be extended to include aliasing arising from non-adjacent bins. For example, replacing X(n,k) with X(n,k−1)+X(n,k−2) allows to estimate the effect of the two left-side nearest neighbours of each bin.

Using this implementation only the effect of the overlap from low frequency to high frequency bins is estimated. Theoretically, the same concept should be applied to cover the overlap arising from high frequency to low frequency bins. However, due to the asymmetric nature of the described problem (the frequency range of the feedback canceller is only reduced in low frequencies) these additional terms can be neglected.

Since the computational cost of the second adaptive filter 9 is roughly the same as that of the first adaptive filter 8, it is advantageous to reduce the frequency range of the second adaptive filter 9 such that it is only active where required. The first adaptive filter 8 is typically operating in the range 1 kHz to 11 kHz. The cross-terms are expected to be particularly problematic in the first 4 to 5 bins located after the cut-off frequency. This is due to the fact that i) the analysis filter banks 2*a*, 2*b* ensure a negligible overlap between two bins whose distance between centre frequencies is more than 500 Hz, and ii) a frequency shift that is used in combination with the feedback canceller is typically active in the frequency range 1.7 kHz to 11 kHz, preventing aliasing artifacts from affecting the corresponding bins. Therefore, the frequency range of the second adaptive filter 9 can typically be narrowed to 1 kHz to 1.7 kHz, which corresponds to bins 6 to 10.

The adaptation speed $\mu(n,k)$ can be specific to the second adaptive filter 9, but it should be similar to the adaptation speed of the first adaptive filter 8 such that both adaptive filters 8 and 9 have the same convergence speed. Otherwise, "pumping" effects between the two adaptive filters 8 and 9 might arise, which could potentially decrease the performance in the case of non-stationary signals.

By adding a parallel, second adaptive filter 9, which estimates the effect of neighbouring lower frequency bins, e.g. in the range of 1 kHz to 1.7 kHz, the effect of cross-terms caused by aliasing from the first adaptive filter 8 can be removed, thus allowing an accurate estimate of the acoustic feedback path in the presence of a strong tonal input outside the operating frequency range of the feedback canceller. Only the output of the first adaptive filter 8 is applied to the main audio signal path of the hearing device, thus ensuring a correct compensation of the acoustic feedback path. The output of the second adaptive filter 9 is only used internally in the feedback canceller to cancel out the effect of the aliasing.

With the proposed solution, the accuracy and efficacy of the feedback canceller is insensitive to input stimuli whose frequency content is outside the operating frequency range. This avoids feedback cancellation artifacts caused by low frequency tonal signals, e.g. ringtone, alarms, air conditioning devices or speech. Thus a substantial improvement of the sound quality can be achieved in such situations, whilst preserving the performance of the feedback cancellation algorithm.

The invention claimed is:

1. A method for feedback cancelling in a hearing device comprising at least one microphone, an analysis filter bank, a gain unit, a synthesis filter bank, a receiver and a feedback canceller comprising a first adaptive filter and a cross filter, the method comprising:

the at least one microphone providing at least one microphone signal;

the analysis filter bank decomposing the at least one microphone signal into a first plurality of sub-band signals;

the gain unit applying a frequency-dependent gain to the first plurality of sub-band signals and providing a first plurality of amplified sub-band signals;

the synthesis filter bank converting the first plurality of amplified sub-band signals into a receiver input signal; and the receiver outputting a sound signal dependent on the receiver input signal, characterised in the first adaptive filter providing a second plurality of feedback compensation signals adapted to compensate acoustic feedback from the receiver to the at least one microphone, and subtracting the second plurality of feedback compensation signals from corresponding signals from the first plurality of sub-band signals to provide a first plurality of feedback compensated sub-band signals;

the cross filter estimating a third plurality of cross-frequency signal components resulting from aliasing of signal components from one sub-band into one or more neighbouring sub-bands caused by non-ideal sub-band signal decomposition in the analysis filter bank with overlapping sub-bands; and adapting the first adaptive filter in dependence of a difference between the first plurality of feedback compensated sub-band signals and corresponding components from the third plurality of estimated cross-frequency signal components.

2. The method of claim 1, further comprising adapting the cross filter in dependence of the difference between the first plurality of feedback compensated sub-band signals and corresponding components from the third plurality of estimated cross-frequency signal components.

3. The method of claim 1, further comprising adapting the first adaptive filter and the cross filter in dependence of the first plurality of amplified sub-band signals, or decomposing the receiver input signal into a fourth plurality of sub-band feedback signals and adapting the first adaptive filter and the cross filter in dependence of the fourth plurality of sub-band feedback signals.

4. The method of claim 1, wherein the first plurality is larger than the second plurality and/or the second plurality is larger than or equal to the third plurality.

5. The method of claim 1, wherein the first adaptive filter is an adaptive two partitions frequency domain filter, whose coefficients are updated according to the following normalised least-mean-squares equations:

$$h_0(n,k) = h_0(n-1,k) + \mu(n,k)\frac{\overline{X(n,k)}E(n,k)}{|X(n,k)|^2}$$

$$h_1(n,k) = h_1(n-1,k) + \mu(n,k)\frac{\overline{X(n-1,k)}E(n,k)}{|X(n,k)|^2}$$

wherein X(n,k) is an n-th sample of the k-th amplified sub-band signal, E(n,k) is the n-th sample at the k-th frequency of an error signal resulting from a subtraction of the second plurality of feedback compensation signals from corresponding signals from the first plurality of sub-band signals, $h_0$ and $h_1$ are filter coefficients of the first and second partitions of the first adaptive filter, respectively, μ(n,k) is a frequency-dependent adaptation speed of the first adaptive filter, and $|X(n,k)|^2$ is a normalisation term of the first adaptive filter, and wherein the cross filter is also an adaptive two partitions frequency domain filter, whose coefficients are updated according to the following normalised least-mean-squares equations:

$$h_{c0}(n,k) = h_{c0}(n-1,k) + \mu_c(n,k)\frac{\overline{X(n,k-1)}E(n,k)}{|X(n,k-1)|^2}$$

$$h_{c1}(n,k) = h_{c1}(n-1,k) + \mu_c(n,k)\frac{\overline{X(n-1,k-1)}E(n,k)}{|X(n,k-1)|^2}$$

wherein $h_0$ and $h_a$ are filter coefficients of the first and second partitions of the cross filter, respectively, and μ(n,k) is a frequency-dependent adaptation speed of the cross filter.

6. The method of claim 5, wherein in the equations for updating the coefficients of the cross filter the terms X(n, k−1) are replaced by the sum X(n,k−1)+X(n,k−2), in particular by the sum of M samples X(n,k−1)+ . . . +X(n,k−M).

7. The method of claim 1, wherein the second plurality of feedback compensation signals from the first adaptive filter are within the frequency range from 800 Hz to 11 kHz.

8. The method of claim 1, wherein the third plurality of cross-frequency signal components from the cross filter are within the frequency range from 800 Hz to 3 kHz, in particular within the frequency range from 1 kHz to 1.7 kHz.

9. A hearing device, comprising:

at least one microphone providing at least one microphone signal;

an analysis filter bank adapted to decompose the at least one microphone signal into a first plurality of sub-band signals;

a gain unit adapted to apply a frequency-dependent gain to the first plurality of sub-band signals and to provide a first plurality of amplified sub-band signals;

a synthesis filter bank adapted to convert the first plurality of amplified sub-band signals into a receiver input signal;

a receiver adapted to output a sound signal dependent on the receiver input signal; and a feedback-canceller unit comprising a first adaptive filter and a cross filter, wherein:

the first adaptive filter is configured to provide a second plurality of feedback compensation signals adapted to compensate acoustic feedback from the receiver to the at least one microphone, and to subtract the second plurality of feedback compensation signals from corresponding signals from the first plurality of sub-band signals to provide a first plurality of feedback compensated sub-band signals, and the cross filter is adapted to estimate a third plurality of cross-frequency signal components resulting from aliasing of signal components from one sub-band into one or more neighbouring sub-bands caused by non-ideal sub-band signal decomposition in the analysis filter bank with overlapping sub-bands, and the first adaptive filter is adapted dependent on a difference between the first plurality of feedback compensated sub-band signals and corresponding components from the third plurality of estimated cross-frequency signal components.

10. The hearing device of claim 9, adapted to perform a method of feedback cancelling comprising:

the at least one microphone providing at least one microphone signal;

the analysis filter bank decomposing the at least one microphone signal into a first plurality of sub-band signals;

the gain unit applying a frequency-dependent gain to the first plurality of sub-band signals and providing a first plurality of amplified sub-band signals;

the synthesis filter bank converting the first plurality of amplified sub-band signals into a receiver input signal;

the receiver outputting a sound signal dependent on the receiver input signal;

the first adaptive filter of the feedback canceller providing a second plurality of feedback compensation signals adapted to compensate acoustic feedback from the receiver to the at least one microphone, which second plurality of feedback compensation signals are subtracted from corresponding signals from the first plurality of sub-band signals;

the second adaptive filter of the feedback canceller estimating a third plurality of cross-frequency signal components resulting from aliasing of signal components from one sub-band into one or more neighbouring sub-bands caused by non-ideal sub-band signal decomposition in the analysis filter bank with overlapping sub-bands; and adapting the first adaptive filter in dependence of the third plurality of estimated cross-frequency signal components; and subtracting the second plurality of feedback compensation signals from corresponding signals from the first plurality of sub-band signals to provide a first plurality of feedback compensated sub-band signals, and adapting the first adaptive filter in dependence of a difference between the first plurality of feedback compensated sub-band signals and corresponding components from the third plurality of estimated cross-frequency signal components.

* * * * *